US010648258B2

(12) United States Patent
Bakker et al.

(10) Patent No.: US 10,648,258 B2
(45) Date of Patent: May 12, 2020

(54) SEALING AND CONTROLLING OF FLUID PRESSURE IN AN ANNULAR FLUID PASSAGEWAY IN A WELLBORE RELATED PROCESS

(71) Applicant: ITREC B.V., Schiedam (NL)

(72) Inventors: Thomas Walburgis Bakker, Hoogeveen (NL); Gerardus Godefridus Johannes Van Og, Hoogeveen (NL); Joop Roodenburg, Schiedam (NL)

(73) Assignee: ITREC B.V., Schiedam (NL)

( * ) Notice: Subject to any disclaimer, the term of this patent is extended or adjusted under 35 U.S.C. 154(b) by 270 days.

(21) Appl. No.: 15/756,001

(22) PCT Filed: Aug. 25, 2016

(86) PCT No.: PCT/NL2016/050592
§ 371 (c)(1),
(2) Date: Feb. 27, 2018

(87) PCT Pub. No.: WO2017/039434
PCT Pub. Date: Mar. 9, 2017

(65) Prior Publication Data

US 2018/0340383 A1 Nov. 29, 2018

(30) Foreign Application Priority Data

Aug. 28, 2015 (NL) ..... 2015363

(51) Int. Cl.
*E21B 33/08* (2006.01)
*E21B 21/08* (2006.01)
(Continued)

(52) U.S. Cl.
CPC ..... *E21B 21/08* (2013.01); *E21B 21/10* (2013.01); *E21B 33/085* (2013.01); *E21B 43/10* (2013.01); *E21B 2021/006* (2013.01)

(58) Field of Classification Search
CPC combination set(s) only.
See application file for complete search history.

(56) References Cited

U.S. PATENT DOCUMENTS 2,670,225 A 2/1954 McKinney
4,821,799 A 4/1989 Wong
(Continued)

FOREIGN PATENT DOCUMENTS

GB 2 233 365 A 1/1991
WO WO 93/23654 A1 11/1993

OTHER PUBLICATIONS

Dutch Search Report, issued in Priority Application No. 2015363, dated Apr. 20, 2016.

(Continued)

*Primary Examiner* — Cathleen R Hutchins
*Assistant Examiner* — Ronald R Runyan
(74) *Attorney, Agent, or Firm* — Birch, Stewart, Kolasch & Birch, LLP

(57) ABSTRACT

In a method for sealing and controlling fluid pressure in an annular fluid passageway in a wellbore related process, use is made of an annular fluid passageway sealing device, which includes a chamber delimited by chamber end members each provided with an opening therein so that the drilling tubulars string passes through said chamber and said chamber end members. The lower chamber end member is exposed, at least partially, to wellbore related fluid pressure in the annular fluid passageway. The housing is provided with an inlet and an outlet in communication with said chamber. Use is made of a pump that circulates a high (Continued)

viscosity liquid. The inlet and the outlet are vertically offset from each other and the chamber is provided with one or more narrow annular gap defining members that are arranged between vertically spaced apart feed and discharge zones. The circulation of liquid and the narrow annular gap are such that shear of the high viscosity liquid is induced resulting in a pressure drop between the discharge zones such that high viscosity liquid pressure in the feed zone assists the lower chamber end member in absorbing the wellbore related fluid pressure.

25 Claims, 6 Drawing Sheets

(51) Int. Cl.

| | |
|---|---|
| ***E21B 21/10*** | (2006.01) |
| ***E21B 43/10*** | (2006.01) |
| *E21B 21/00* | (2006.01) |

(56) References Cited

U.S. PATENT DOCUMENTS

| | | | |
|---|---|---|---|
| 8,347,983 | B2 | 1/2013 | Hoyer et al. |
| 8,844,617 | B1 | 9/2014 | Baker |
| 2013/0192847 | A1 | 8/2013 | Bailey et al. |

OTHER PUBLICATIONS

International Search Report, issued in PCT/NL2016/050592, dated Nov. 3, 2016.
Written Opinion of the International Searching Authority, issued in PCT/NL2016/050592, dated Nov. 3, 2016.

SEALING AND CONTROLLING OF FLUID PRESSURE IN AN ANNULAR FLUID PASSAGEWAY IN A WELLBORE RELATED PROCESS

FIELD OF THE INVENTION

The present invention relates to the field of performing wellbore related processes, e.g. drilling into subterranean formations, e.g. subsea formations, e.g. in view of hydrocarbons exploration or geothermal well drilling, etc.

BACKGROUND OF THE INVENTION

In the field, e.g. in the course of so-called closed mud or other drilling fluid circulation processes, e.g. in Managed Pressure Drilling (MPD), underbalanced drilling, etc., use is made of rotating control devices (RCDs) having internal sealing elements. Examples thereof are e.g. disclosed in U.S. Pat. No. 8,347,983.

In U.S. Pat. No. 8,347,983 a method for sealing and controlling fluid pressure in an annular fluid passageway in a wellbore related process is disclosed. In the method a fluid, drilling mud, passes through the annular fluid passageway around a drilling tubulars string. Use is made of an annular fluid passageway sealing device, which sealing device comprises:

- a housing,
- a chamber within said housing,
- a lower chamber end member delimiting said chamber at a lower end thereof,
- an upper chamber end member delimiting said chamber at an upper end thereof, wherein the lower and upper chamber end member are each provided with an opening therein, which openings are aligned on an axis of the sealing device and are dimensioned so that the drilling tubulars string passes along said axis through said chamber and said chamber end members, wherein the housing is provided with:

- an inlet in communication with said chamber to introduce liquid into said chamber,
- an outlet in communication with said chamber to discharge liquid from said chamber, wherein further use is made of a liquid pump that feeds liquid into said chamber via said inlet, e.g. circulates liquid through said chamber via said inlet and outlet, wherein the liquid within the chamber is in direct contact with the drilling tubulars string passing through the chamber.

In U.S. Pat. No. 8,347,983 the introduction of liquid into the chamber and/or the circulation through said chamber, aims to transfer some of the drilling mud pressure that is exerted onto the lower chamber end member, or lower sealing element to the upper sealing element or elements, so that a load sharing of the lower and upper end members is achieved.

OBJECT OF THE INVENTION

The present invention aims to provide an improved method and sealing device or at least an alternative.

SUMMARY OF THE INVENTION

The present invention provides a method which is characterized in that the inlet and the outlet are vertically offset from each other, wherein the inlet feeds into a feed zone of the chamber adjacent the lower chamber end member and wherein the outlet discharges from a discharge zone of the chamber adjacent the upper chamber end member, and in that the chamber is provided with one or more narrow annular gap defining members that are arranged between said vertically spaced apart feed zone and discharge zone and that envelope the drilling tubular string, and in that the one or more narrow annular gap defining members define in combination with the drilling tubular string an elongated and radially narrow annular gap through which said circulating liquid passes from the feed zone to the discharge zone, and in that the circulated liquid is a high viscosity liquid, and in that the circulation of said high viscosity liquid and the narrow annular gap are such that shear of the high viscosity liquid is induced in said elongated and radially narrow annular gap, resulting in a pressure drop between said feed zone and said discharge zone such that high viscosity liquid pressure in said feed zone assists the lower chamber end member in absorbing the wellbore related fluid pressure in said annular fluid passageway.

In practice, e.g. due to some horizontal plane motion (swirling) of the drilling tubulars string relative to the one or more narrow annular gap defining members and/or due to some bending/misalignment of the drilling tubulars string the narrow gap may not be perfectly uniform around the drilling tubulars string. These imperfections, which will mostly vary over time, still allow for a reliable establishing of the desired pressure drop and thereby maintaining a desired pressure in the feed zone of the chamber to assist the lower chamber end member in absorbing the drilling fluid, e.g. mud, pressure in the annular passageway. At the same time the inventive approach allows to reduce any drilling fluid induced load on the upper chamber end member as well, e.g. the pressure drop being such that in the discharge zone an ambient or near ambient pressure is present.

Due to the assistance provided by the high viscosity liquid pressure in the feed zone, any wear of the lower chamber end member, e.g. a resilient stripper member, may be significantly reduced. The same benefit may apply to the upper chamber end member, e.g. embodied as resilient stripper member.

In an embodiment the entire, or nearly entire, e.g. 80%, of the pressure difference between the wellbore related fluid in the annular fluid passageway on the one hand and the ambient pressure, e.g. above the upper chamber end member, on the other hand, is absorbed by pressure in the feed zone, with the pressure drop over the length of the narrow gap equaling said pressure difference or portion thereof.

In an embodiment the pressure in the feed zone equals, or is controlled to be equal to, the wellbore related fluid pressure in the annular passageway directly beneath the lower chamber end member, so that this lower chamber end member is effectively not or not significantly loaded in axial direction, thus vertically load balanced. This complete balancing of vertical loads on the lower chamber end member greatly reduces any wear of the lower chamber end member, e.g. when designed as a resilient end member contacting the drilling tubulars string, e.g. as a resilient stripper member.

It is envisaged that the lower chamber end member, preferably balanced in axial or vertical direction as explained above, may or will act primarily as a scraper that scrapes drilling fluid, e.g. mud, from the drilling tubulars string so as to avoid or reduce entry of drilling fluid into the chamber of the sealing device and mixing thereof with the high viscous liquid circulated through the mixing device.

For example the lower chamber end member is embodied as a resilient stripper member, e.g. as known in the art.

Preferably the lower chamber end member and/or upper chamber end member, each or in combination, have a pressure rating such that in case of the mentioned high viscous liquid circulation being absent and/or no pressure drop being established by the narrow gap for other causes, the lower and/or upper chamber end members, alone or in combination, are able to withstand the pressure of the wellbore related fluid in the annular fluid passageway. So these end members, alone or in combination, can act as a conventional stripper seal member as known also from non-pressure assisted RCD devices. For example the pressure rating of the lower chamber end member and/or upper chamber end member, each or in combination, is at least 1.000 psi (dynamic), e.g. at least 2.500 psi (dynamic).

In an embodiment, as preferred, the wellbore related fluid pressure in the annular fluid passageway is measured, e.g. directly beneath the lower chamber end member, and the high viscosity liquid pressure in the feed zone is controlled in response to this measurement of the wellbore related fluid pressure by means of variation of the circulation of said high viscosity liquid and/or of the narrow annular gap. It will be appreciated that a computerized control unit may be provided that is linked to a pressure sensor for measuring the wellbore related fluid pressure in the annular fluid passageway on the one hand and to the pump and/or any control device—if present—of the one or more narrow annular gap defining members on the other hand. For example a routine is programmed into the control unit to automatically effect a variation of the high viscosity liquid pressure in the feed zone when the wellbore related fluid pressure in the annular fluid passageway changes. A further pressure sensor, also linked to the computerized control unit, may be provided to measure the liquid pressure in the feed zone, e.g. included in a control loop.

In practical embodiments, it is envisaged that the narrow annular gap has a radial width of between 0.5 and 3.0 millimeters, e.g. between 0.5 and 1.5 millimeters, e.g. about 1 millimeter. For example this nominal size of the narrow annular gap is envisaged for drilling tubular strings having a diameter between 4 and 8 inches, e.g. 7 inch drilling tubulars.

In practical embodiments, it is envisaged that the elongated and narrow annular gap has a length of at least 0.3 meter, e.g. at least 0.5 meter. It will be appreciated that a suitable length will for example depend on the pressure difference to be handled by the sealing device, etc.

In practical embodiments, it is envisaged that the high viscosity liquid has a viscosity of at least 500.000 Centipoise (cP), e.g. at least 1.000.000 Centipoise (cP).

In practical embodiments, it is envisaged that the high viscosity liquid contains bentonite, e.g. a mixture of bentonite and water, e.g. said mixture further containing calcium carbonate.

In practical embodiments, it is envisaged that the lower and/or upper chamber end members are embodied with one or more resilient stripper members frictionally engaging the drilling tubulars string. As indicated above such resilient, e.g. rubber, stripper members are known in the art. Examples of suitable stripper members and details thereof are e.g. disclosed in mentioned U.S. Pat. No. 8,347,983.

In practical embodiments the lower and/or upper chamber end members are rotatably mounted in the housing allowing the rotatably mounted lower and/or upper chamber end members to revolve in unison with a rotation of the drilling tubulars string. This rotary mounting of the end member or end members, e.g. multiple end members mounted on a common tubular rotary carrier, allows to further reduce wear of the end member as the end member will be able to rotate along with the drilling tubulars string, e.g. during drilling.

In practical embodiments a storage vessel is provided wherein a volume of high viscosity liquid is stored, which storage vessel is connected to the circulation pump in order to compensate liquid loss via the sealing device. It is preferred that the lower and/or upper chamber end members are designed to scrape along the drilling tubulars string so as to scrape adhering high viscosity liquid from the string, yet this may not be entirely perfect resulting in a loss of said liquid that needs to be replenished.

In practical embodiments it is envisaged that the high viscous liquid may become mixed with drilling fluid, e.g. mud that adhered to the drilling tubulars string (e.g. during tripping out). This may impair the properties of the high viscous liquid, e.g. be detrimental to the sealing device and/or circulation pump. In embodiments the viscous liquid in the system or part thereof may be replaced, e.g. at intervals or based on an analysis of the liquid, by new or cleaned liquid. In an embodiment a contamination, e.g. cuttings, separation device is integrated in the return of the liquid from the sealing device to the pump.

In practical embodiments the drilling tubulars string is composed of drilling tubulars that are at one or each end therefor provided with larger-diameter tool joint portion having a larger diameter than the main body or pipe body of the tubular. In an embodiment it is envisaged that the elongated and radially narrow annular gap is defined between this larger-diameter tool joint portion and the one or more narrow annular gap defining members. For example the chamber has such a length that during tripping the drilling tubulars string in and out of the wellbore always at least one tool joint is located in the chamber so as to form the desired narrow gap. In practical embodiments the chamber may be at least 30 ft., e.g. at least 40 ft.

In an embodiment the sealing device is used in an offshore drilling process, e.g. wherein the sealing device is arranged above water, e.g. as part of a riser string.

In an embodiment, preferably for use with a drilling tubulars string having larger-diameter tool joints at least one narrow annular gap defining member is embodied as a fixed diameter member, e.g. said fixed diameter member being removably mounted in the housing allowing arrangement of a fixed diameter member adapted to the diameter of the tool joint portions of the drilling tubular string.

It is noted that the drilling tubulars string may also be composed of drilling tubulars that have flush ends, or connected by a flush intermediate coupling, therefore lacking larger diameter tool joints, e.g. at least over a section of the length of the string.

The drilling tubular string could be for example a string of drill pipes, but may e.g. also be a string of casing sections.

It is noted that the drilling tubulars string may also be formed by a coiled tubing type drill string, preferably having a uniform diameter over the length thereof or at least over a significant section of the length of the coiled tubing string.

In a preferred embodiment at least one, preferably each, narrow annular gap defining member is embodied as a controllable variable diameter member that is adapted to controllably vary the diameter thereof. For example the variable diameter member can be set, or allowed to be expanded, to a diameter indicated as a tool joint passage diameter allowing for the passage of a tool joint portion in the drilling tubulars string, e.g. said diameter being somewhat greater than the tool joint diameter. For example, e.g.

in combination with the ability to assume a tool joint passage diameter, the variable diameter member can be set to a tubular main body diameter wherein an effective narrow annular gap is present between the main body of a drilling tubular (so less than of the tool joint) and the variable diameter member.

In an embodiment at least one, preferably each, narrow annular gap defining member is embodied as an inflatable and deflatable variable diameter member adapted to controllably vary the diameter. For example the inflation is done by means of pneumatic pressure, e.g. with pressurized air being fed in controlled manner to the variable diameter member in order to reduce the effective diameter of the member.

In an embodiment the inflatable and deflatable variable diameter member comprises a tubular bladder of resilient material, e.g. of rubber or other materials, e.g. as discussed in U.S. Pat. No. 8,347,983 for the stripper members, delimiting the narrow annular gap.

In a preferred embodiment the elongated and narrow gap is delimited by a series of multiple gap sections in axial array. For example multiple controllable variable diameter members are arranged in series between the feed zone and the discharge zone, each adapted to controllably vary the diameter. For example the series of multiple controllable variable diameter members is longer than the length of a larger diameter tool joint in the passing drilling tubulars string. This for example allows for a method wherein—for the passage of a tool joint first one or more variable diameter members at the upper or lower end of the series (depending on the direction of the string) are brought into a tool joint passage diameter and then the more central variable diameters so as to achieve a peristaltic motion of the series allowing for the passage of the tool joint. During this peristaltic motion it may, if desired, be possible to maintain an effective shear inducing gap between one or more of the variable diameter members and the drilling tubulars string.

In a preferred embodiment multiple controllable variable diameter members are provided between the feed zone and the discharge zone, each adapted to controllably vary the diameter, are arranged in series between the feed zone and the discharge zone, each controllable variable diameter members being independently controllable.

In a preferred embodiment multiple controllable variable diameter members are provided between the feed zone and the discharge zone, each adapted to controllably vary the diameter. These variable diameter members are arranged in series. In a preferred embodiment multiple controllable variable diameter members are mounted in a common carrier, e.g. a common carrier that is exchangeable mounted in the housing of the sealing device, e.g. a common carrier that is rotatably mounted in the housing.

In an embodiment one or more controllable variable diameter members are rotatably mounted in the housing, e.g. allowing the one or more members to rotate along with the drilling tubulars string, e.g. in case of any contact between them so as to reduce any wear of the variable diameter members.

In an embodiment a diverter housing is mounted below the sealing device, e.g. as is known in Managed Pressure Drilling or other closed mud circulation drilling techniques. The diverter housing may have a central passage through which the drilling tubulars string passes and forming the annular fluid passageway around a drilling tubulars string, and said diverter housing having a lateral port in communication with said annular fluid passageway.

In an embodiment the sealing device comprises multiple chambers in series, separated by intermediate chamber end members and each chamber being provided with the narrow gap members as discussed herein.

The present invention also relates to a system for sealing and controlling fluid pressure in an annular fluid passageway in a wellbore related process, wherein a wellbore related fluid passes through the annular fluid passageway around a drilling tubulars string, e.g. in a closed fluid circulation wellbore related process, e.g. in a managed pressure drilling process, which system comprises an annular fluid passageway sealing device, which sealing device comprises:

a housing, a chamber within said housing, a lower chamber end member delimiting said chamber at a lower end thereof, an upper chamber end member delimiting said chamber at an upper end thereof, wherein the lower and upper chamber end member are each provided with an opening therein, which openings are aligned on an axis of the sealing device and are dimensioned so that—in operation—the drilling tubulars string passes along said axis through said chamber and said chamber end members, wherein the lower chamber end member is arranged to be exposed, at least partially, to wellbore related fluid pressure in said annular fluid passageway, wherein the housing is provided with:

an inlet in communication with said chamber to introduce a liquid into said chamber, an outlet in communication with said chamber to discharge said liquid from said chamber, wherein the system further comprises a pump that is adapted to feed said liquid into said chamber via said inlet, said liquid being discharged via said outlet and returned to the pump so that—in operation—said liquid is circulated through said chamber via said inlet and outlet, wherein the sealing device is embodied such that the liquid circulated through the chamber is in direct contact with the drilling tubulars string passing through the chamber, characterized in that the inlet and the outlet are vertically offset from each other, wherein the inlet feeds into a feed zone of the chamber adjacent the lower chamber end member and wherein the outlet discharges from a discharge zone of the chamber adjacent the upper chamber end member, and in that the chamber is provided with one or more narrow annular gap defining members that are arranged between said vertically spaced apart feed zone and discharge zone and that—in operation—envelope the drilling tubular string, and in that the one or more narrow annular gap defining members define—in operation—in combination with the drilling tubular string an elongated and radially narrow annular gap through which said circulating liquid passes from the feed zone to the discharge zone, and in that the circulated liquid is a high viscosity liquid, and in that the circulation of said high viscosity liquid and the narrow annular gap are such that—in operation—shear of the high viscosity liquid is induced in said elongated and radially narrow annular gap, resulting in a pressure drop between said feed zone and said discharge zone such that high viscosity liquid pressure in said feed zone assists the lower chamber end member in absorbing the wellbore related fluid pressure in said annular fluid passageway.

The present invention also relates to a method for performing a wellbore related process, wherein a wellbore related fluid passes through the annular fluid passageway around a drilling tubulars string drilling and wherein a fluid pressure is present in said annular fluid passageway, e.g. managed pressure drilling, wherein use is made of a system as described herein for sealing and controlling said fluid pressure in the annular fluid passageway.

The present invention also relates to a rotating control device for sealing and controlling a fluid pressure in an annular fluid passageway during a wellbore related process, e.g. in a closed fluid circulation wellbore related process, e.g. in a managed pressure drilling process, said rotating control device comprising:

a housing, a chamber within said housing, a lower chamber end member delimiting said chamber at a lower end thereof, an upper chamber end member delimiting said chamber at an upper end thereof, wherein the lower and upper chamber end member are each provided with an opening therein, which openings are aligned on an axis of the sealing device and are dimensioned so that—in operation—the drilling tubulars string passes along said axis through said chamber and said chamber end members, wherein the lower chamber end member is arranged to be exposed, at least partially, to wellbore related fluid pressure in said annular fluid passageway, wherein the housing is provided with:

an inlet in communication with said chamber to introduce a liquid into said chamber, an outlet in communication with said chamber to discharge said liquid from said chamber, wherein a pump that is connectable to the inlet in order to feed said liquid into said chamber via said inlet, said liquid being discharged via said outlet and returned to the pump so that—in operation—said liquid is circulated through said chamber via said inlet and outlet, wherein the rotating control device is embodied such that the liquid circulated through the chamber is in direct contact with the drilling tubulars string passing through the chamber, characterized in that the inlet and the outlet are vertically offset from each other, wherein the inlet feeds into a feed zone of the chamber adjacent the lower chamber end member and wherein the outlet discharges from a discharge zone of the chamber adjacent the upper chamber end member, and in that the chamber is provided with one or more narrow annular gap defining members that are arranged between said vertically spaced apart feed zone and discharge zone and that—in operation—envelope the drilling tubular string, and in that the one or more narrow annular gap defining members define—in operation—in combination with the drilling tubular string an elongated and radially narrow annular gap through which said circulating liquid passes from the feed zone to the discharge zone, and in that the circulated liquid is a high viscosity liquid, and in that the circulation of said high viscosity liquid and the narrow annular gap are such that—in operation—shear of the high viscosity liquid is induced in said elongated and radially narrow annular gap, resulting in a pressure drop between said feed zone and said discharge zone such that high viscosity liquid pressure in said feed zone assists the lower chamber end member in absorbing the wellbore related fluid pressure in said annular fluid passageway.

The invention also relates to a method for closed fluid circulation drilling of a wellbore, wherein use is made of a system and/or sealing device as described herein. For example the drilling tubulars string, e.g. a drill pipes string or a casing string, is rotatably driven, e.g. by a top drive device. In another example the drilling tubulars string is a coiled tubing string.

The present invention also relates to a closed fluid circulation drilling rig comprising a system and/or sealing device as described herein, for example wherein the rig comprises a top drive device to rotatably drive the drilling tubulars string, e.g. a drill pipes string or a casing string composed of interconnected tubulars provided with tool joint portions, during drilling of the wellbore.

The invention also relates to the combination a system as described herein for sealing and controlling fluid pressure in an annular fluid passageway in a wellbore related process, wherein a wellbore related fluid passes through the annular fluid passageway around a drilling tubulars string, and a drilling tubulars string passing along said axis through said chamber and said chamber end members, wherein the one or more narrow annular gap defining members define in combination with the drilling tubular string an elongated and radially narrow annular gap through which—in operation—said circulating liquid passes from the feed zone to the discharge zone.

In an embodiment the drilling tubulars string comprises interconnected drilling tubulars each having a tubular main body and at one or each end thereof a tool joint portion of greater diameter than said tubular main body, wherein at least one, preferably each, narrow annular gap defining member is embodied as a controllable variable diameter member (82-85) adapted to controllably vary the diameter to a tool joint passage diameter allowing for the passage of a tool joint portion in the drilling tubulars string and a tubular main body diameter wherein an effective narrow annular gap is present between the main body of a drilling tubular and the variable diameter member.

The invention will now be described with reference to the appended drawings.

DETAILED DESCRIPTION OF EMBODIMENTS

Figure 1:
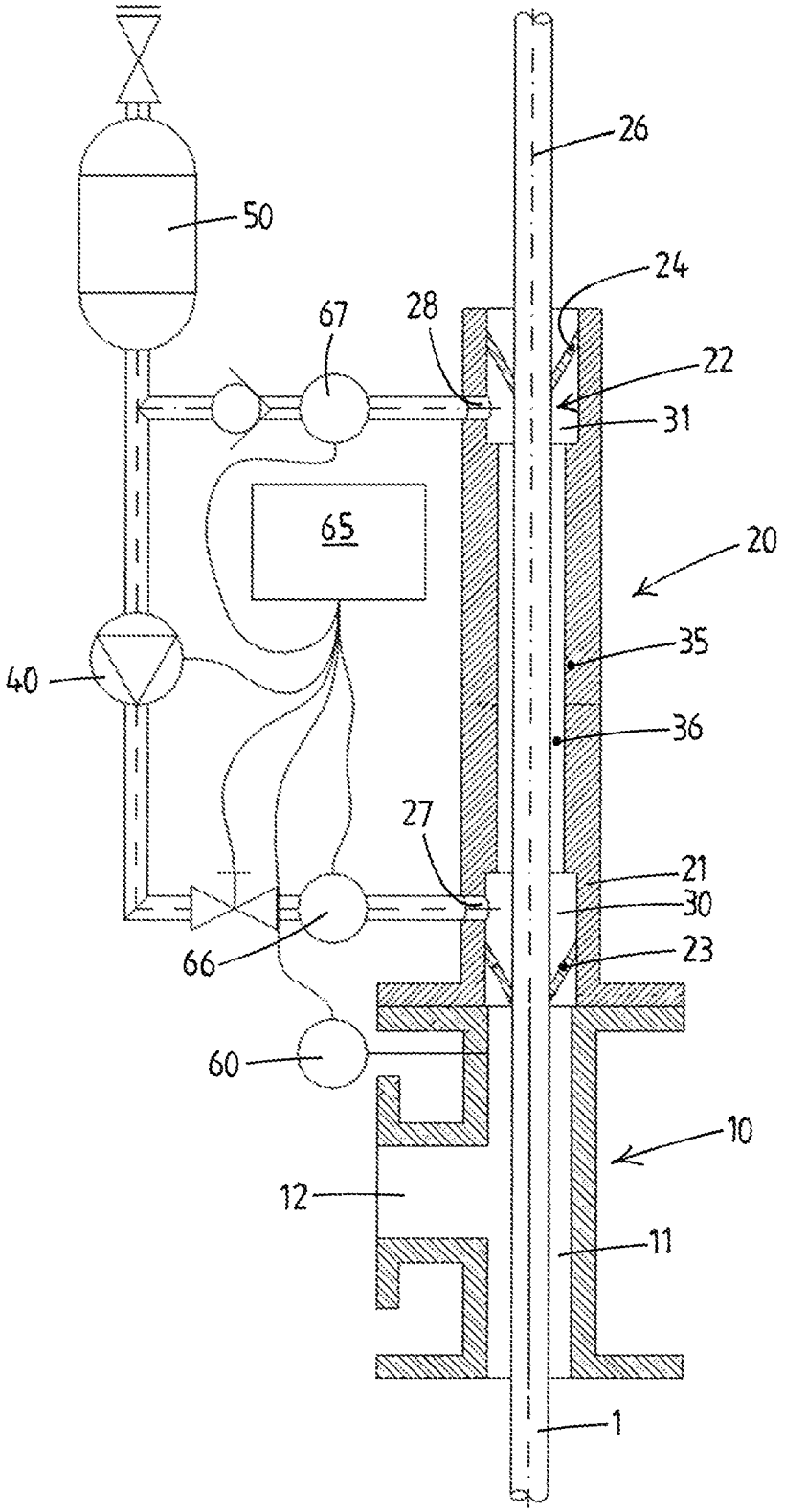
FIG. 1 shows schematically a first embodiment of a system according to the invention for sealing and controlling fluid pressure in an annular fluid passageway in a wellbore related process.

In FIG. 1 a drilling tubulars string 1 is depicted. The string 1 may be a coiled tubing string.

Also illustrated is a diverter housing 10 and a sealing device 20, also known to the skilled person as rotating control device (RCD).

The diverter housing 10 is mounted below the sealing device 20, e.g. connected thereto by bolted flanges or a clamping device, e.g. a hydraulic clamping device.

The skilled person recognizes that a diverter housing 10 and sealing device 20 are often used in Managed Pressure Drilling or other closed mud circulation drilling techniques.

The diverter housing 10 has a central passage through which the drilling tubulars string 1 passes and forms the annular fluid passageway 11 around a drilling tubulars string. For example in offshore drilling this passageway connects to the annular fluid passageway between a subsea riser and the string 1.

The diverter housing 10 has a lateral port 12 in communication with the annular fluid passageway 11. This lateral port 12 diverts drilling fluid, e.g. mud and cuttings from the annular passageway. For example a choke manifold connects to the port 12 to allow control of the wellbore related fluid pressure. Downstream of the choke manifold separation equipment may be provided to remove cutting from the mud, allowing the mud to be returned into the wellbore via the drilling tubular string 1.

In an embodiment the diverter housing 10 is integral with then housing of the sealing device 20, so the sealing device then has a lateral port 12 to divert drilling fluid.

In closed circulation drilling techniques it is envisaged that at the height of the diverter housing 10 the pressure of the drilling fluid, e.g. mud, can be controlled, e.g. by a choke manifold downstream of the diverter housing 10, instead of being ambient as in an open mud circulation system. In order to allow for control of the wellbore related fluid, e.g. drilling mud, the sealing device 20 is provided.

In practical applications the sealing device 20 and diverter 10 may be arranged on top of a Blow Out Preventer (BOP). In another application these components (possibly integrated) can be arranged on top of a telescopic joint for offshore drilling. I The sealing device 20 comprises:

- a housing 21,
- a chamber 22 within said housing 21,
- a lower chamber end member 23 delimiting said chamber 22 at a lower end thereof,
- an upper chamber end member 24 delimiting said chamber 22 at an upper end thereof.

The lower and upper chamber end members 23, 24 are each provided with an opening therein and these openings are aligned on an axis 26 of the sealing device 20 and are dimensioned so that—in operation—the drilling tubulars string 1 passes along this axis 26 through said chamber 22 and said chamber end members 23, 24.

It is illustrated that the lower and upper chamber end members 23, 24 are embodied with one or more resilient stripper members frictionally engaging the drilling tubulars string 1. As indicated above such resilient, e.g. rubber, stripper members are known in the art. Often a cone shape stripper member is employed. Examples of suitable stripper members and details thereof are e.g. disclosed in mentioned U.S. Pat. No. 8,347,983.

As will be appreciated the lower chamber end member 23 is arranged to be exposed, at least partially, to the wellbore related fluid pressure in the annular fluid passageway 11.

The lower chamber end member 23, e.g. embodied as cone shaped resilient stripper member, could be arranged at the height of the lateral port 12.

The housing 21 is provided with:

- an inlet 27 in communication with the chamber 22 to introduce a liquid into the chamber,
- an outlet 28 in communication with the chamber 22 to discharge said liquid from the chamber 22.

The system further comprises a pump 40 that is adapted to feed the liquid into the chamber 22 via the inlet 27. This liquid is discharged via the outlet 28 and then returned to the pump 40 so that—in operation—this liquid is circulated through the chamber 22 via the inlet 27 and the outlet 28.

As can be seen the sealing device 20 is embodied such that the liquid circulated through the chamber 22 is in direct contact with the drilling tubulars string 1 passing through the chamber 22.

As can be seen the inlet 27 and the outlet 28 are vertically offset from each other. The inlet 27 feeds into a feed zone 30 of the chamber 22 adjacent the lower chamber end member 23. The outlet 28 discharges from a discharge zone 31 of the chamber 22 that is adjacent the upper chamber end member 24.

The chamber is further bounded by one or more narrow annular gap defining members 35, here effectively one gap defining member 35 formed as an elongated throat or reduced diameter section of the housing body of the sealing device.

The gap defining member 35 is arranged between the vertically spaced apart feed zone 30 and discharge zone 31. As can be seen—in operation—the gap defining member 35 envelopes the drilling tubular string 1.

The one or more narrow annular gap defining members, here member 35, define—in operation—in combination with the drilling tubular string 1 an elongated and radially narrow annular gap 36 through which the circulating liquid passes from the feed zone 30 to the discharge zone 31. The radial width of this gap 36 is shown exaggerated in FIG. 1 and will in practical embodiments be between 0.5 and 3.0 millimeters, e.g. between 0.5 and 1.5 millimeters, e.g. about 1 millimeter. For example this nominal size of the narrow annular gap is envisaged for drilling tubular strings having a diameter between 4 and 8 inches, e.g. 7 inch drilling tubulars.

In practical embodiments, the elongated and narrow annular gap 36 may have a length of at least 0.3 meter, e.g. at least 0.5 meter, e.g. about 0.6 meters as suggested in FIG. 1. It will be appreciated that a suitable length will for example depend on the pressure difference to be handled by the sealing device 20, etc.

The circulated liquid is a high viscosity liquid, e.g. containing bentonite, e.g. a mixture of bentonite and water, e.g. said mixture further containing calcium carbonate. For example the high viscosity liquid has a viscosity of at least $0.5\times10^6$ Centipoise (cP), e.g. at least $1.0\times10^6$ Centipoise (cP). It is noted that bentonite is commonly used as component of drilling mud and therefore it use in the high viscous liquid to be circulated is advantageous.

In operation of the sealing device 20 with the pump 40 the circulation of the high viscosity liquid and the narrow annular gap are such that shear of the high viscosity liquid is induced in the elongated and radially narrow annular gap 36, resulting in a pressure drop between the feed zone 30 and the discharge zone 31 such that high viscosity liquid pressure in the feed zone 30 assists the lower chamber end member 23 in absorbing the wellbore related fluid pressure in the annular fluid passageway 11.

The pump 40 could e.g. be a piston pump with one or more pistons for circulation of the liquid. A possible alternative is e.g. a screw pump.

For example in an embodiment the entire pressure difference between the wellbore related fluid in the annular fluid passageway 11 below the lower chamber end member 23 on the one hand and the ambient pressure, here above the upper chamber end member 24, on the other hand, is absorbed by pressure in the feed zone, with the pressure drop over the length of the narrow gap 36 equaling said pressure difference thereof. Of course a residual above atmospheric pressure could exist at the level of the discharge chamber, with the upper member 24 being loaded by the remaining difference to ambient pressure.

It will appreciated that in order to achieve the desired pressure drop the gap 36 may have a rather significant length for practical wellbore related operations. In offshore application such a length may well be acceptable, e.g. when the drill floor is significantly above waterline, but land drilling rigs may equally accommodate long length sealing devices.

FIG. 1 further illustrates the presence of a storage vessel 50 wherein a volume of high viscosity liquid is stored. This storage vessel is connected to the circulation pump 40 in order to compensate liquid loss via the sealing device 20. It is preferred that the lower and/or upper chamber end members 23, 24 are designed to scrape along the drilling tubulars string so as to scrape adhering high viscosity liquid from the string, yet this may not be entirely perfect resulting in a loss of said liquid that needs to be replenished.

As in practical wellbore related processes the fluid in the passageway 11 may vary, the FIG. 1 illustrates a pressure sensor 60 to measure the wellbore related fluid pressure in the annular fluid passageway 11, e.g. directly beneath the lower chamber end member 23.

It is envisaged that the high viscosity liquid pressure in the feed zone 30 is controlled in response to this measurement of the wellbore related fluid pressure by means of variation of the circulation of said high viscosity liquid and/or of the narrow annular gap (the latter not in FIG. 1).

A computerized control unit 65 is provided that is linked to the pressure sensor 60 and to the pump 40 on the other hand. For example a routine is programmed into the control unit to automatically effect a variation of the high viscosity liquid pressure in the feed zone when the wellbore related fluid pressure in the annular fluid passageway changes. A further pressure sensor 66, also linked to the computerized control unit 65, is provided to measure the liquid pressure in the feed zone 30, e.g. included in a control loop. It is also illustrated that yet another pressure sensor 67 is provided to measure the pressure in the discharge zone 31, this sensor also being linked to the control unit. On the basis of sensors 66, 67 the established pressure drop can be monitored.

Figure 2:
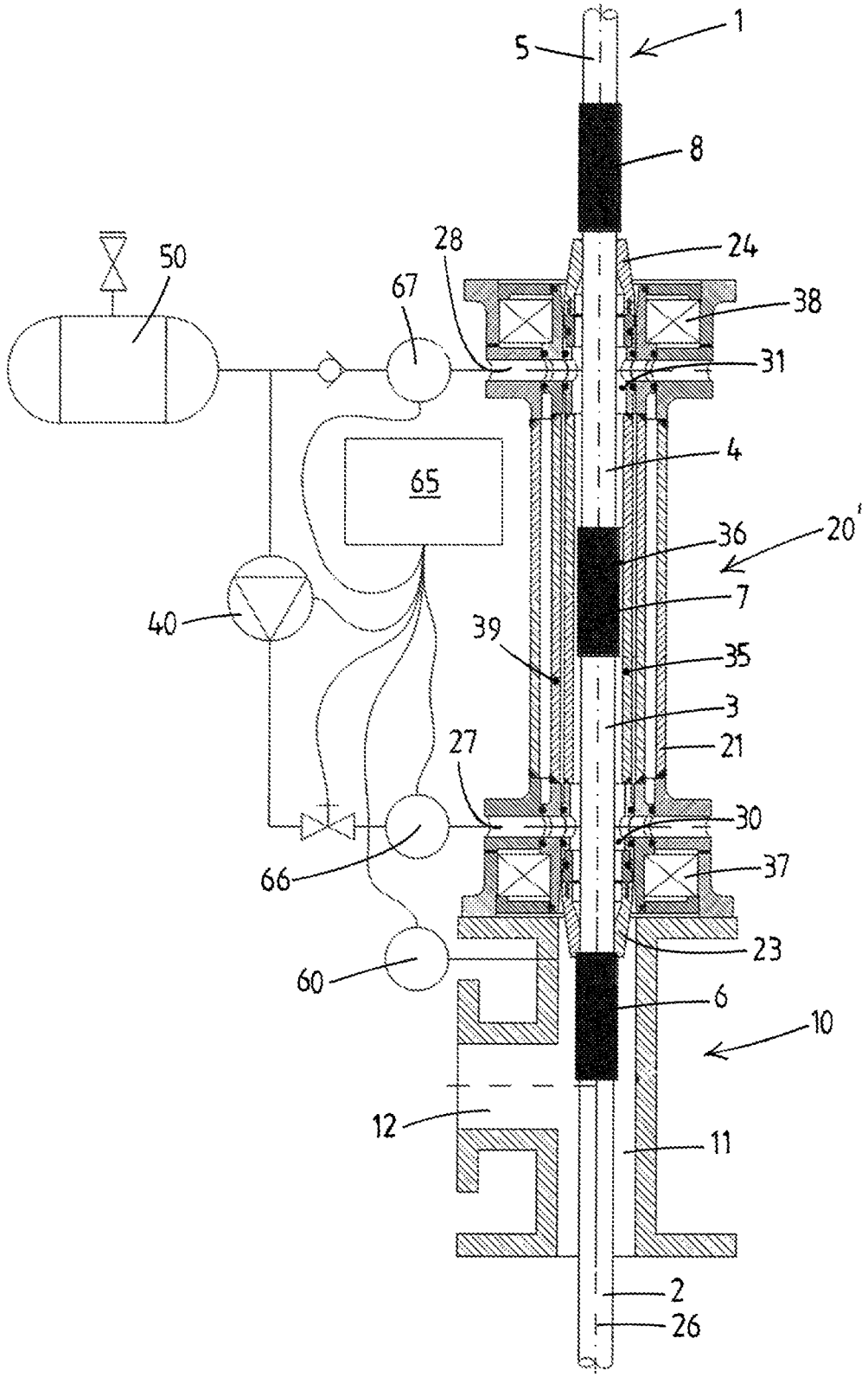
FIG. 2 shows schematically a second embodiment of a system according to the invention for sealing and controlling fluid pressure in an annular fluid passageway in a wellbore related process.

FIG. 2 depicts a second embodiment wherein the same components are provided with the same reference numerals.

In FIG. 2 it is illustrated that the drilling tubular string 1 is composed of drilling tubulars 2, 3, 4, 5 that are at one or each end therefor provided with larger-diameter tool joint portion 6, 7, 8 having a larger diameter than the main body or pipe body of the respective tubular.

In this embodiment it is envisaged or possible that the elongated and radially narrow annular gap 36 is defined between this larger-diameter tool joint portion, here portion 7, on the one hand and the one or more narrow annular gap defining members 35. It is illustrated that the chamber 22, or series of adjoining chambers in a non-depicted embodiment, has such a length that during tripping the drilling tubulars string in and out of the wellbore always at least one tool joint 6, 7, 8 is located in the chamber 22 so as to form the desired narrow gap 36.

In FIG. 2 it is illustrated that, like in FIG. 1, the narrow annular gap defining member 35 is embodied as a fixed diameter member, so without provision to vary the diameter thereof whilst operative in the sealing device 20.

The fixed diameter member 35 here is removably mounted in the housing 21 which allows to exchange one member 35 for another having a different fixed diameter in order to adapt the sealing device 20 to the tubulars of the drill string, here to the diameter of the tool joint portions of the drilling tubular string 1.

It is illustrated here that the end members 23, 24 form an assembly with the removably mounted fixed diameter member, so that these members 23, 24 are exchanged as well along with the member 35 in case of handling another diameter tubular string.

It is illustrated here that the stationary housing 21 is provided rotary bearings 37, 38 that rotatably support, about axis of the device 20, a tubular receiver for the exchangeable assembly of the one or more narrow passage defining members 35 and, as preferred, the lower and upper chamber end members 23, 24. This causes that both the end members 23, 24 as well as the one or more narrow passage defining members 35 are rotatable about the axis of the sealing device and thus able to revolve along with any rotation of the drilling tubulars string 1.

In an embodiment a lubricant circulation is provided for one or more of the bearings 37, 38, e.g. oil being circulated along each of the bearings.

In an embodiment the sealing device 20 is provided with a coolant circuit for circulating a coolant, e.g. glycol, through one or more components of the sealing device 20 in order to remove heat, e.g. to cool the bearings 37, 38.

Figure 3:
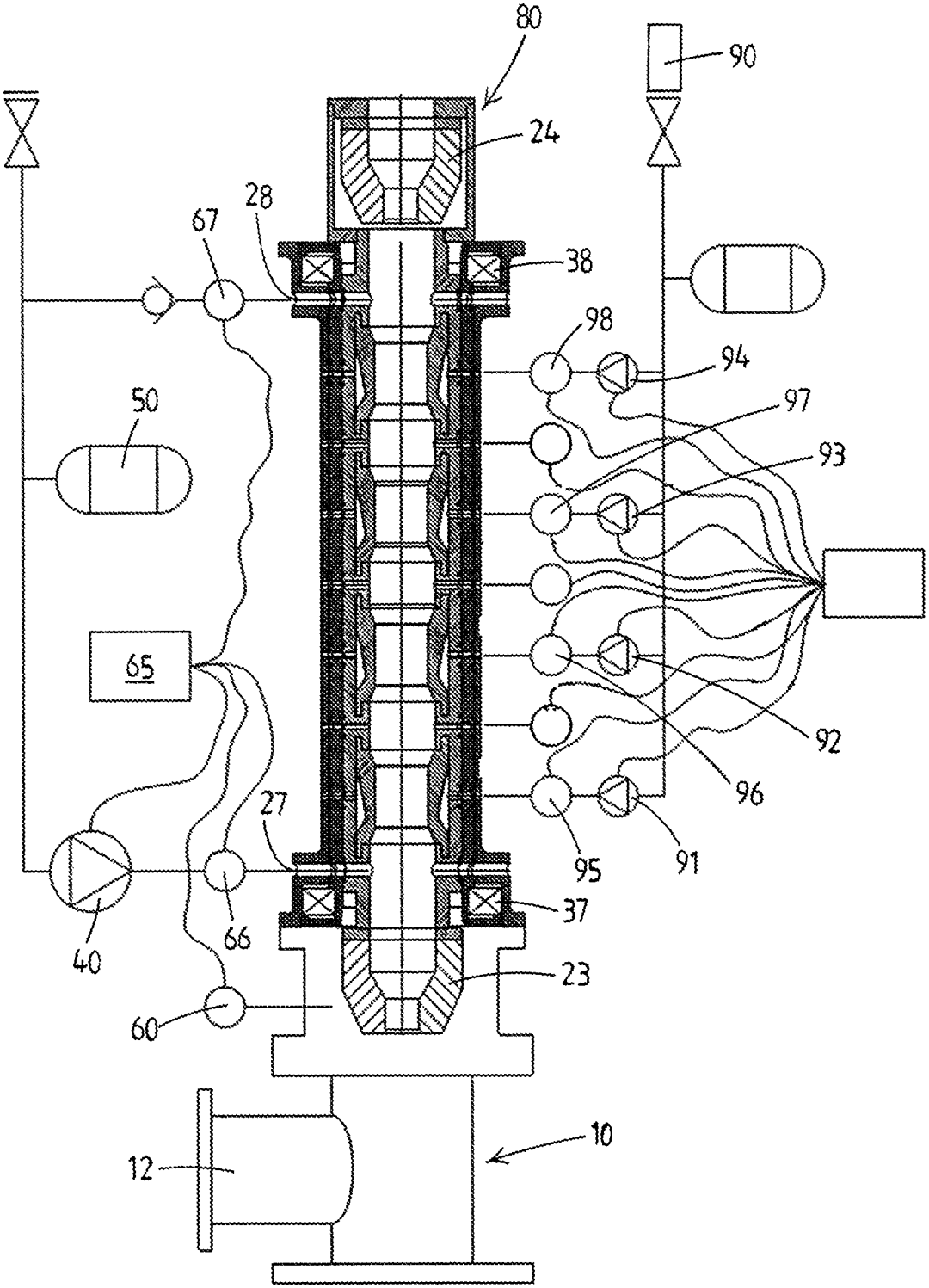
FIG. 3 shows schematically a third embodiment of a system according to the invention for sealing and controlling fluid pressure in an annular fluid passageway in a wellbore related process.

FIG. 3 depicts a third embodiment wherein the same components are provided with the same reference numerals as in FIGS. 1 and/or 2.

Figure 4A:
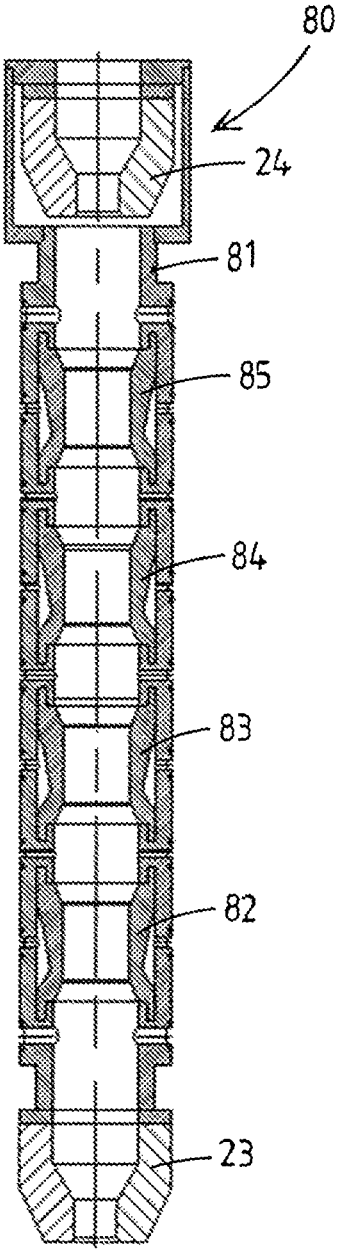
FIG. 4*a* shows schematically the exchangeable rotary carrier with chamber end members and variable diameter members of the system of FIG. 3.
Figure 4B:
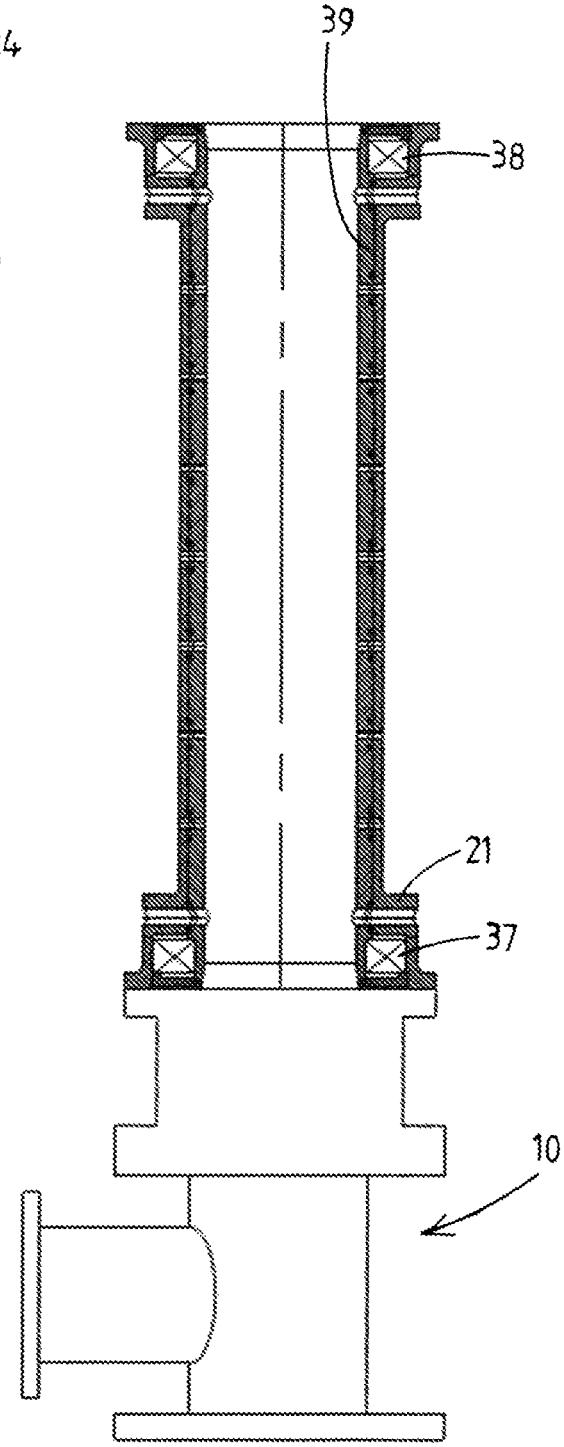
FIG. 4*b* shows schematically the stationary housing of the sealing device and the diverter housing of the system of FIG. 3.
Figure 5:
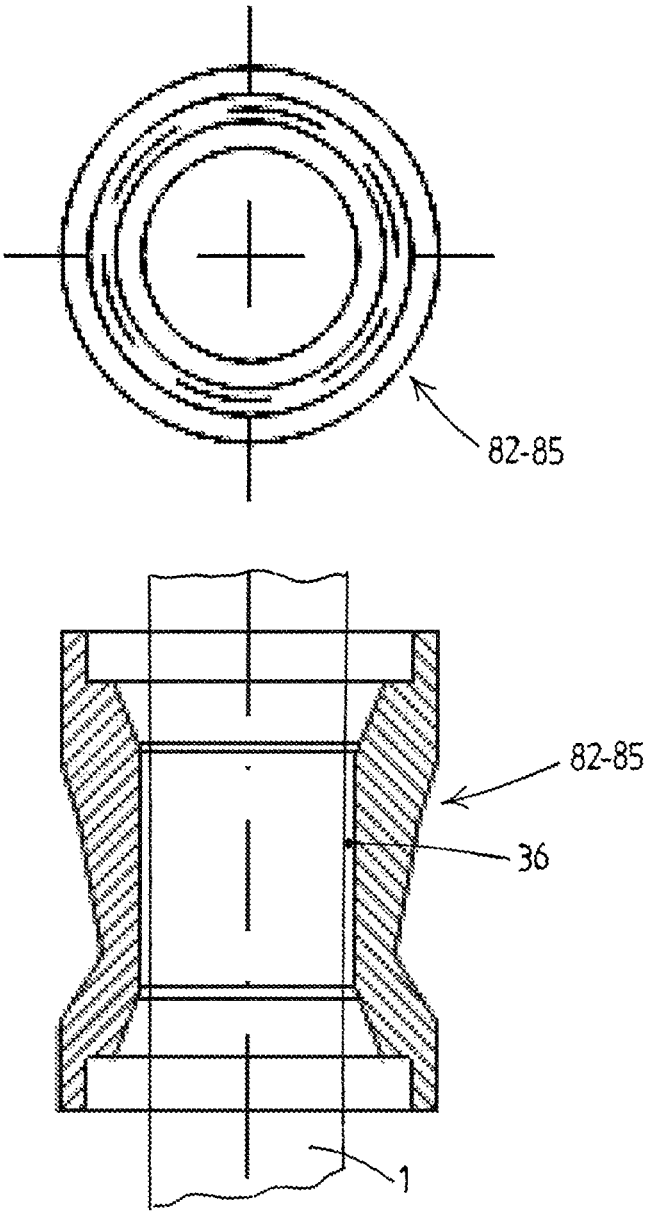
FIG. 5 shows in top view and cross section a tubular resilient bladder of the system of FIG. 3.
Figure 6:
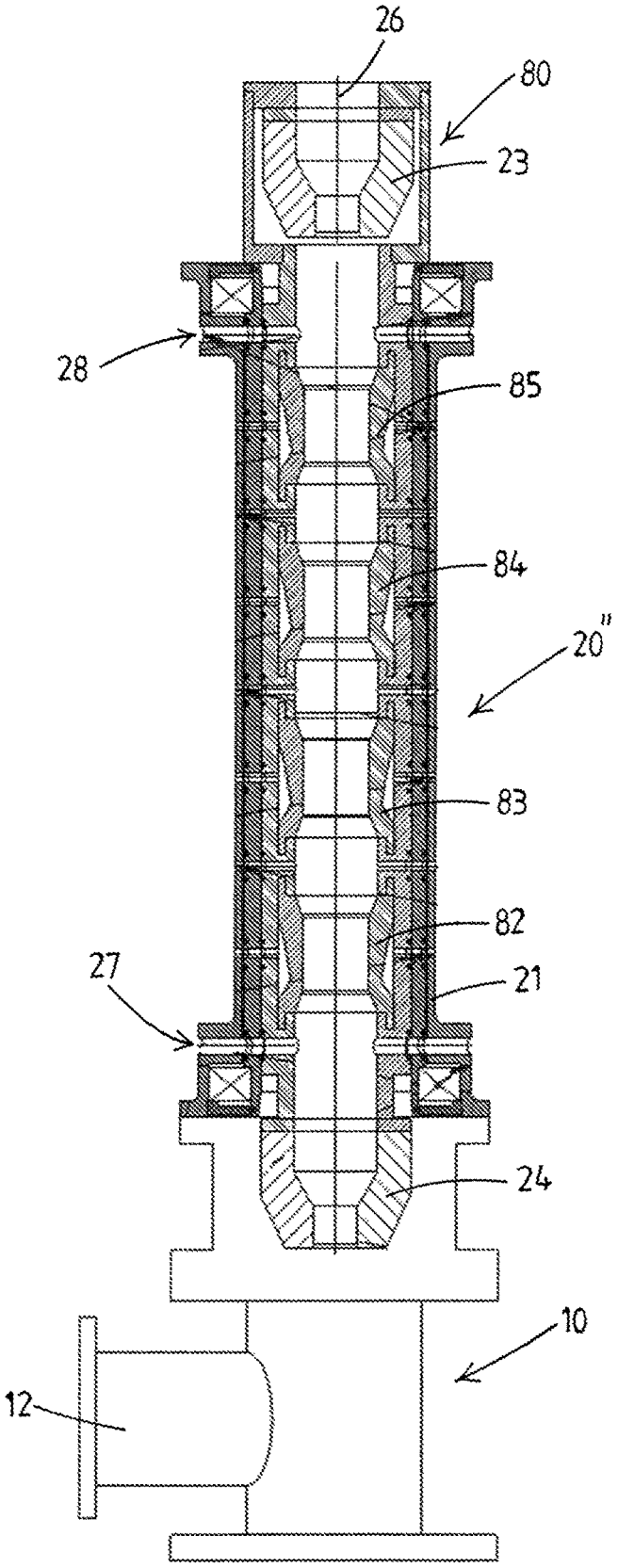
FIG. 6 illustrates the sealing device of the system of FIG. 3.

The exchangeable assembly 80 is shown in FIG. 4*a* and is rotatably mounted in the stationary part of the housing 21 shown in FIG. 4*b*. As in FIG. 2 the housing 21, via bearings 37, 38, rotatably supports a tubular receiver 39 into which the assembly 80 can be inserted (from above).

The assembly 80 is composed of a common tubular rotary carrier 81 that supports at the lower and upper ends thereof the lower and upper chamber end members 23, 24 respectively.

In addition the carrier 81 here supports a series of multiple controllable variable diameter members 82, 83, 84, 85.

Each controllable variable diameter members 82, 83, 84, 85 is adapted to controllably vary the inner diameter thereof.

Here each member 82, 83, 84, 85 is embodied as an inflatable and deflatable variable diameter member that is adapted to controllably vary the inner diameter. In the depicted embodiments each of the inflatable and deflatable variable diameter members 82, 83, 84, 85 comprises a tubular bladder of resilient material, e.g. of (natural) rubber or other materials, e.g. oil-resistant polyurethane, e.g. as discussed in U.S. Pat. No. 8,347,983 for the stripper members, delimiting the narrow annular gap. A variable volume chamber 88, 89, 90, 91, is present on the outside of the bladder, between the bladder and the tubular carrier 81.

The inflation, and thereby reduction of the inner diameter, of the members 82, 83, 84, 85 is done by means of pneumatic or hydraulic pressure. Here a source 90 of pressurized fluid, e.g. air or hydraulic liquid, is depicted. The inflation/deflation of each member 82, 83, 84, 85 is governed independently, here by provision of a respective valve 91, 92, 93, 94 and a respective pressure sensor 95, 96, 97, 98.

For example each of the variable diameter members 82, 83, 84, 85 can be set, or allowed to be expanded by the pressure of the circulated liquid, to a diameter indicated as a tool joint passage diameter allowing for the passage of a tool joint portion in the drilling tubulars string 1, e.g. said diameter being somewhat greater than the tool joint diameter. For example, e.g. in combination with the ability to assume a tool joint passage diameter, the variable diameter member can be set to a tubular main body diameter wherein an effective narrow annular gap is present between the main body of a drilling tubular (so less than of the tool joint) and the variable diameter member.

The series of multiple controllable variable diameter members 82, 83, 84, 85 is longer than the length of a larger diameter tool joint in the passing drilling tubulars string. This for example allows for a method wherein—for the passage of a tool joint—first one or more variable diameter members at the upper or lower end of the series (depending on the direction of the string) are brought into a tool joint passage diameter and then the more central variable diameters so as to achieve a peristaltic motion of the series allowing for the passage of the tool joint. During this peristaltic motion it may, if desired, be possible to maintain an effective shear inducing gap between one or more of the variable diameter members and the drilling tubulars string.

As indicated it is preferred for the variable diameter members 82-85 to be embodied as resilient material devices. In an alternative the one or more variable diameter members comprise one or more rigid members that are mobile by means of one or more associated actuators in order to create the desired gap with the drilling tubulars string.

In yet another alternative, a resilient tubular variable diameter member is varied with respect to its inner diameter by controlled twisting of the member as the one edge is twisted relative to the other edge. This approach is resembles the disclosure of U.S. Pat. No. 8,844,617 as far as the diameter variation is concerned.

In preferred embodiments the circulated liquid is a Newtonian liquid, e.g. containing bentonite.

In an alternative embodiment the circulated liquid is a shear thickening liquid, wherein the shear induced by the narrow gap causes the liquid to thicken and thus increase the flow resistance. It is envisaged that once this liquid leaves the narrow gap, the shear is reduced and thereby the liquid will return to a less viscous state allowing it to be discharged via the outlet and returned to the pump. The pump is preferably designed to avoid the shear thickening effect from being induced by the pump itself, e.g. a piston pump being used with suitably chosen piston(s).

In an alternative embodiment the liquid is a magnetorheological liquid, which liquid includes magnetic or magnetisable particles. This will require the provision of the sealing device with a thickened state inducing arrangement that includes a magnetic field assembly that establishes a magnetic field to which said magnetic or magnetisable particles respond and thereby induce and/or maintain the thickened state of said liquid, or at least assist in said inducing and/or maintaining of the thickened state. In such an embodiment it is envisaged that, if desired, the magnetic field is varied by provision of a suitable magnetic field assembly in order to influence the viscosity of the liquid. In another embodiment, or in combination therewith, one or more permanent magnets are used to create a magnetic field. In an embodiment the magnetic field assembly is included in the control of the pressure in the feed zone, e.g. the field being varied in response to a measure pressure of the wellbore related fluid in the passageway.

One could envisage a liquid that is both shear thickening and magnetorheological. If a magnetorheological liquid is used the magnetic effect is an additional source for a pressure drop along the narrow gap in addition to the shear induced pressure drop.

The invention claimed is:

1. A method for sealing and controlling fluid pressure in an annular fluid passageway in a wellbore related process, wherein a wellbore related fluid passes through the annular fluid passageway around a drilling tubulars string, wherein use is made of an annular fluid passageway sealing device, which sealing device comprises:

a housing;

a chamber within said housing;

a lower chamber end member delimiting said chamber at a lower end thereof; and an upper chamber end member delimiting said chamber at an upper end thereof, wherein the lower chamber end member and the upper chamber end member are each provided with an opening therein, which openings are aligned on an axis of the sealing device and are dimensioned so that the drilling tubulars string passes along said axis through said chamber and said lower and upper chamber end members, wherein the lower chamber end member is exposed, at least partially, to a wellbore related fluid pressure in said annular fluid passageway, wherein the housing is provided with:

an inlet in communication with said chamber to introduce a liquid into said chamber; and an outlet in communication with said chamber to discharge said liquid from said chamber, wherein further use is made of a pump that feeds said liquid into said chamber via said inlet, said liquid being discharged via said outlet and returned to the pump so that said liquid is circulated through said chamber via said inlet and outlet, wherein the liquid circulated through the chamber is in direct contact with the drilling tubulars string that passes through the chamber, wherein the inlet and the outlet are vertically offset from each other, wherein the inlet feeds into a feed zone of the chamber, which feed zone is adjacent the lower chamber end member and wherein the outlet discharges from a discharge zone of the chamber, which discharge zone is adjacent the upper chamber end member, wherein the chamber is provided with one or more narrow annular gap defining members that are arranged between said vertically spaced apart feed zone and discharge zone, which one or more narrow annular gap defining members envelope the drilling tubular string, wherein the one or more narrow annular gap defining members define in combination with the drilling tubulars string an elongated and radially narrow annular gap through which said circulating liquid passes from the feed zone to the discharge zone, wherein the liquid that is circulated through the chamber is a high viscosity liquid, and wherein the circulation of said high viscosity liquid and the elongated and radially narrow annular gap are such that shear of the high viscosity liquid is induced in said elongated and radially narrow annular gap, resulting in a pressure drop between said feed zone and said discharge zone such that high viscosity liquid pressure in said feed zone assists the lower chamber end member in absorbing the wellbore related fluid pressure in said annular fluid passageway to which said lower chamber end member is exposed.

2. The method according to claim 1, wherein the wellbore related fluid pressure in said annular fluid passageway is measured, and wherein the high viscosity liquid pressure in said feed zone is controlled in response to said measurement of the wellbore related fluid pressure by means of a variation of the circulation of said high viscosity liquid and/or a variation of the narrow annular gap.

3. The method according to claim 1, wherein said narrow annular gap has a radial width of between 0.5 and 3.0 millimeters.

4. The method according to claim 1, wherein said elongated and narrow annular gap has a length of at least 0.3 meter.

5. The method according to claim 1, wherein the high viscosity liquid has a viscosity of at least $0.5\times10^6$ Centipoise (cP).

6. The method according to claim 1, wherein the high viscosity liquid contains bentonite.

7. The method according to claim 1, wherein the lower chamber end member and/or the upper chamber end member is embodied with one or more resilient stripper members frictionally engaging the drilling tubulars string.

8. The method according to claim 1, wherein the lower chamber end member and/or the upper chamber end member is rotatably mounted in the housing allowing the rotatably mounted lower chamber end member and/or the rotatably mounted upper chamber end member to revolve in unison with a rotation of the drilling tubulars string.

9. The method according to claim 1, wherein a storage vessel is provided wherein a volume of said high viscosity liquid is stored, which storage vessel is connected to the circulation pump in order to compensate for a liquid loss via the sealing device.

10. The method according to claim 1, wherein the drilling tubulars string is composed of drilling tubulars having ends, which drilling tubulars are at one or each end thereof provided with larger-diameter tool joint portion, and wherein an elongated and radially narrow annular gap is defined between at least one larger-diameter tool joint portion and the one or more narrow annular gap defining members.

11. The method according to claim 10, wherein at least one narrow annular gap defining member is embodied as a fixed diameter member which is removably mounted in the housing allowing arrangement of a selected fixed diameter member in order to adapt to a diameter of the tool joint portions of the drilling tubular string.

12. The method according claim 1, wherein at least one narrow annular gap defining member is embodied as a controllable variable diameter member adapted to controllably vary the diameter to a tool joint passage diameter allowing for the passage of a tool joint portion in the drilling tubulars string and to a tubular main body diameter wherein an effective narrow annular gap is present between a main body of a drilling tubular and the variable diameter member.

13. The method according to claim 1, wherein at least one narrow annular gap defining member is embodied as an inflatable and deflatable variable diameter member adapted to controllably vary the diameter of the narrow annular gap defining member.

14. The method according to claim 13, wherein said inflatable and deflatable variable diameter member comprises a bladder of resilient material delimiting the narrow annular gap.

15. The method according to claim 1, wherein the elongated and narrow gap is delimited by a series of multiple gap sections arranged in series between the feed zone and the discharge zone.

16. The method according to claim 1, wherein multiple controllable variable diameter members, each adapted to controllably vary the diameter, are arranged in series between the feed zone and the discharge zone, each controllable variable diameter members being independently controllable.

17. The method according to claim 1, wherein multiple controllable variable diameter members, each adapted to controllably vary the diameter, are arranged in series between the feed zone and the discharge zone, and wherein said multiple controllable variable diameter members are mounted in a common carrier.

18. The method according to claim 1, wherein a diverter housing is mounted below the sealing device, said diverter housing having a central passage through which the drilling tubulars string passes and forming the annular fluid passageway around a drilling tubulars string, and said diverter housing having a lateral port in communication with said annular fluid passageway.

19. A system for sealing and controlling fluid pressure in an annular fluid passageway in a wellbore related process, wherein a wellbore related fluid passes through the annular fluid passageway around a drilling tubulars string, which system comprises an annular fluid passageway sealing device, which sealing device comprises:

a housing;

a chamber within said housing;

a lower chamber end member delimiting said chamber at a lower end thereof; and an upper chamber end member delimiting said chamber at an upper end thereof, wherein the lower chamber end member and the upper chamber end members are each provided with an opening therein, which openings are aligned on an axis of the sealing device and are dimensioned so that, in operation, the drilling tubulars string passes along said axis through said chamber and said chamber end members, wherein the lower chamber end member is arranged to be exposed, at least partially, to a wellbore related fluid pressure in said annular fluid passageway, wherein the housing is provided with:

an inlet in communication with said chamber to introduce a liquid into said chamber; and an outlet in communication with said chamber to discharge said liquid from said chamber, wherein the system further comprises a pump that is adapted to feed said liquid into said chamber via said inlet, said liquid being discharged via said outlet and returned to the pump so that, in operation, said liquid is circulated through said chamber via said inlet and outlet, wherein the sealing device is embodied such that the liquid that is circulated through the chamber is in direct contact with the drilling tubulars string passing through the chamber, wherein the inlet and the outlet are vertically offset from each other, wherein the inlet is adapted to feed into a feed zone of the chamber, which feed zone is adjacent the lower chamber end member, and wherein the outlet is adapted to discharge from a discharge zone of the chamber, which discharge zone is adjacent the upper chamber end member, wherein the chamber is provided with one or more narrow annular gap defining members that are arranged between said vertically spaced apart feed zone and discharge zone and that, in operation, envelope the drilling tubular string, wherein the one or more narrow annular gap defining members define, in operation, in combination with the drilling tubular string an elongated and radially narrow annular gap through which said circulating liquid passes from the feed zone to the discharge zone, wherein the liquid that is circulated through the chamber is a high viscosity liquid, and wherein the circulation of said high viscosity liquid and the narrow annular gap are such that, in operation, shear of the high viscosity liquid is induced in said elongated and radially narrow annular gap, resulting in a pressure drop between said feed zone and said discharge zone such that high viscosity liquid pressure in said feed zone assists the lower chamber end member in absorbing the wellbore related fluid pressure in said annular fluid passageway to which said lower chamber end member is exposed.

20. A method for performing a wellbore related process, wherein a wellbore related fluid passes through the annular fluid passageway around a drilling tubulars string drilling and wherein a fluid pressure is present in said annular fluid passageway, wherein use is made of the system according to claim 19 for sealing and controlling said fluid pressure in said an annular fluid passageway.

21. A rotating control device for sealing and controlling a fluid pressure in an annular fluid passageway during a wellbore related process, said rotating control device comprising:

a housing;

a chamber within said housing;

a lower chamber end member delimiting said chamber at a lower end thereof; and an upper chamber end member delimiting said chamber at an upper end thereof, wherein the lower chamber end member and the upper chamber end member are each provided with an opening therein, which openings are aligned on an axis of the sealing device and are dimensioned so that, in operation, the drilling tubulars string passes along said axis through said chamber and said chamber end members, wherein the lower chamber end member is arranged to be exposed, at least partially, to wellbore related fluid pressure in said annular fluid passageway, wherein the housing is provided with:

an inlet in communication with said chamber to introduce a liquid into said chamber; and an outlet in communication with said chamber to discharge said liquid from said chamber, wherein a pump is connectable to the inlet in order to feed said liquid into said chamber via said inlet, said liquid being discharged via said outlet and returned to the pump so that, in operation, said liquid is circulated through said chamber via said inlet and outlet, wherein the rotating control device is embodied such that the liquid circulated through the chamber is in direct contact with the drilling tubulars string passing through the chamber, wherein the inlet and the outlet are vertically offset from each other, wherein the inlet is adapted to feed into a feed zone of the chamber, which feed zone is adjacent the lower chamber end member, and wherein the outlet is adapted to discharge from a discharge zone of the chamber, which discharge zone is adjacent the upper chamber end member, wherein the chamber is provided with one or more narrow annular gap defining members that are arranged between said vertically spaced apart feed zone and discharge zone and that, in operation, envelope the drilling tubular string, wherein the one or more narrow annular gap defining members define, in operation, in combination with the drilling tubular string an elongated and radially narrow annular gap through which said circulating liquid passes from the feed zone to the discharge zone, wherein the liquid that is circulated through the chamber is a high viscosity liquid, and wherein the circulation of said high viscosity liquid and the narrow annular gap are such that, in operation, shear of the high viscosity liquid is induced in said elongated and radially narrow annular gap, resulting in a pressure drop between said feed zone and said discharge zone such that high viscosity liquid pressure in said feed zone assists the lower chamber end member in absorbing the wellbore related fluid pressure in said annular fluid passageway.

22. In combination the system according to claim 19 for sealing and controlling fluid pressure in an annular fluid passageway in a wellbore related process, wherein a wellbore related fluid passes through the annular fluid passageway around a drilling tubulars string, and a drilling tubulars string passing along said axis through said chamber and said chamber end members, wherein the one or more narrow annular gap defining members define in combination with the drilling tubular string an elongated and radially narrow annular gap through which, in operation, said circulating liquid passes from the feed zone to the discharge zone.

23. The combination of claim 22, wherein the drilling tubulars string comprises interconnected drilling tubulars each having a tubular main body and at one or each end thereof a tool joint portion of greater diameter than said tubular main body, wherein at least one narrow annular gap defining member is embodied as a controllable variable diameter member adapted to controllably vary the diameter to a tool joint passage diameter allowing for the passage of a tool joint portion in the drilling tubulars string and a to tubular main body diameter wherein an effective narrow annular gap is present between the main body of a drilling tubular and the variable diameter member.

24. The method according to claim 17, wherein the common carrier is exchangeable mounted in the housing.

25. The method according to claim 17, wherein the common carrier is rotatably mounted in the housing.

* * * * *